US005950415A

United States Patent [19]

Stahlecker

[11] Patent Number: 5,950,415

[45] Date of Patent: Sep. 14, 1999

[54] OPENING DEVICE FOR AN OPEN-END SPINNING MACHINE AND METHOD OF MAKING SAME

[75] Inventor: Gerd Stahlecker, Eislingen/Fils, Germany

[73] Assignee: Novibra GmbH, Suessen, Germany

[21] Appl. No.: 09/021,456

[22] Filed: Feb. 10, 1998

[30] Foreign Application Priority Data

Feb. 22, 1997 [DE] Germany ..... 197 07 074

[51] Int. Cl.[6] ..... D01H 4/00

[52] U.S. Cl. ..... 57/408; 57/411

[58] Field of Search ..... 57/404, 406, 408, 57/413, 411, 301, 304; 19/98, 112, 114

[56] References Cited

U.S. PATENT DOCUMENTS 5,465,567 11/1995 Schmolke et al. ..... 57/304
5,867,974 2/1999 Schmid ..... 57/304

FOREIGN PATENT DOCUMENTS 1309206 3/1973 United Kingdom .

*Primary Examiner*—William Stryjewski
*Attorney, Agent, or Firm*—Evenson McKeown Edwards & Lenahan PLLC

[57] ABSTRACT

A flexible sealing ring is arranged at an opening roller of an open-end spinning machine which rotates in a chamber of a housing connected to a vacuum source, which sealing ring is supported concentrically to the opening roller in the housing. In order to seal the chamber against the open atmosphere, the sealing ring comprises a sealing lip, to which a sealing surface of a collar of the opening roller is arranged. The sealing ring is disposed, under the action of the pressure drop present between the open atmosphere and the chamber, on a stopping surface which determines the operational position of the sealing ring, which stopping surface is itself arranged preferably at the housing, while, however, in some embodiments, it is arranged at the opening roller itself. The sealing lip defines the smallest diameter of the sealing ring, which is larger than the diameter of the combing structure of the opening roller.

31 Claims, 7 Drawing Sheets

OPENING DEVICE FOR AN OPEN-END SPINNING MACHINE AND METHOD OF MAKING SAME

BACKGROUND AND SUMMARY OF THE INVENTION

This application claims the priority of German application 197 07 074.4 filed in Germany on Feb. 22, 1997, the disclosure of which is expressly incorporated by reference herein.

The present invention relates to an opening device for an open-end spinning machine comprising an opening roller having combing structure, which opening roller rotates in a chamber of a housing connected to a vacuum source. The opening roller comprises a sealing surface, to which is arranged a sealing lip of a flexible sealing ring concentrically arranged with respect to the opening roller and supported in the housing, which sealing ring seals the chamber against the open atmosphere.

In the case of an opening device of this type (British patent 1,309,206), the sealing ring is a component part of a labyrinth seal, with which a lateral wall of the opening roller is sealed off against a corresponding side wall of the housing. The sealing lips of the sealing ring are so formed, that either with the lateral wall of the opening roller or the lateral wall of the housing a labyrinth is formed, which effects the pressure drop between the open atmosphere and the chamber. Labyrinth seals of this type are difficult to make with respect to the tolerances between the sealing lips and the walls of the opening roller and the housing, in particular when a wall of the housing is formed by a removable lid. Very high demands are made of the finishing accuracy.

It is an object of the present invention to seal the chamber of an opening device effectively against the open atmosphere without too high demands being made with regard to the tolerances to be observed.

This object has been achieved in accordance with the present invention in that the sealing ring is disposed on a stopping surface which determines its operational position by the action of the pressure drop present between the open atmosphere and the chamber, and in that the sealing lip, which defines the smallest diameter of the sealing ring, is larger than the diameter of the combing structure.

As a result of this design, the considerable pressure drop between the open atmosphere and the chamber is used to advantage to place the sealing lip in its operational position. Furthermore, the chosen diameter ratios make it possible to omit any form of opening roller housing lid, as the opening roller can be laterally assembled in the housing through the sealing ring. Due to the chosen width (inside diameter) of the sealing lip, there is no risk of damage to the sealing ring by the sharp combing structure. As the presence of a lid is not needed to contribute to the sealing effect, the sealing rings can be arranged on both sides of the opening roller in one and the same housing, which facilitates production.

The stopping surface defining the operational position of the sealing lip can either be arranged on the opening roller or on the housing. Should the stopping surface be arranged on the opening roller, it then preferably is formed by a bevel of a lateral collar of the opening roller. If, however, the stopping surface is arranged on the housing, the sealing lip, forming a sealing surface, is arranged on the outer circumference of a lateral collar of the opening roller.

In order to attain a good sealing effect, the sealing lip is dragged along the sealing surface during the running-in time of the sealing ring. After a few days, the sealing ring will have already ground in to such a degree that it touches the sealing surface at most very slightly, and causes no notable increase in power consumption.

In an advantageous embodiment of the present invention a floating sealing ring is provided. During the first run of the opening roller, the floating sealing ring finds its ideal position and does not normally come into contact with the sealing surface from then on.

A lateral collar of the opening roller may be provided in the area of the sealing ring, which collar forms an additional sealing gap with the housing by means of its cylindrical outer surface. The overall sealing effect is thereby increased.

A stepped collar with a larger and an adjacent smaller diameter is provided according to certain preferred embodiments, whereby the additional sealing gap is arranged at the smaller diameter and the combing structure is directly adjacent the smaller diameter. The sealing lip of the sealing ring is arranged on the larger diameter of the collar, so that during assembly of the opening roller, the combing structure cannot damage the sealing lip.

It is recommended that the sealing ring is run in already in the place of production on a special assembly device, so that during the first run of the open-end spinning machine in the spinning mill, it is ensured that all opening rollers run at the same speed and are not slowed down to any great degree by any sealing rings. If, at a later time, individual sealing rings must be replaced, this does not effect the power consumption of the open-end spinning machine in any significant way. If it were necessary to exchange all sealing rings of an open-end spinning machine at the same time, then it is recommended to let the open-end spinning machine run idle for about an hour, so that no spinning errors occur due to opening rollers rotating too slowly.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
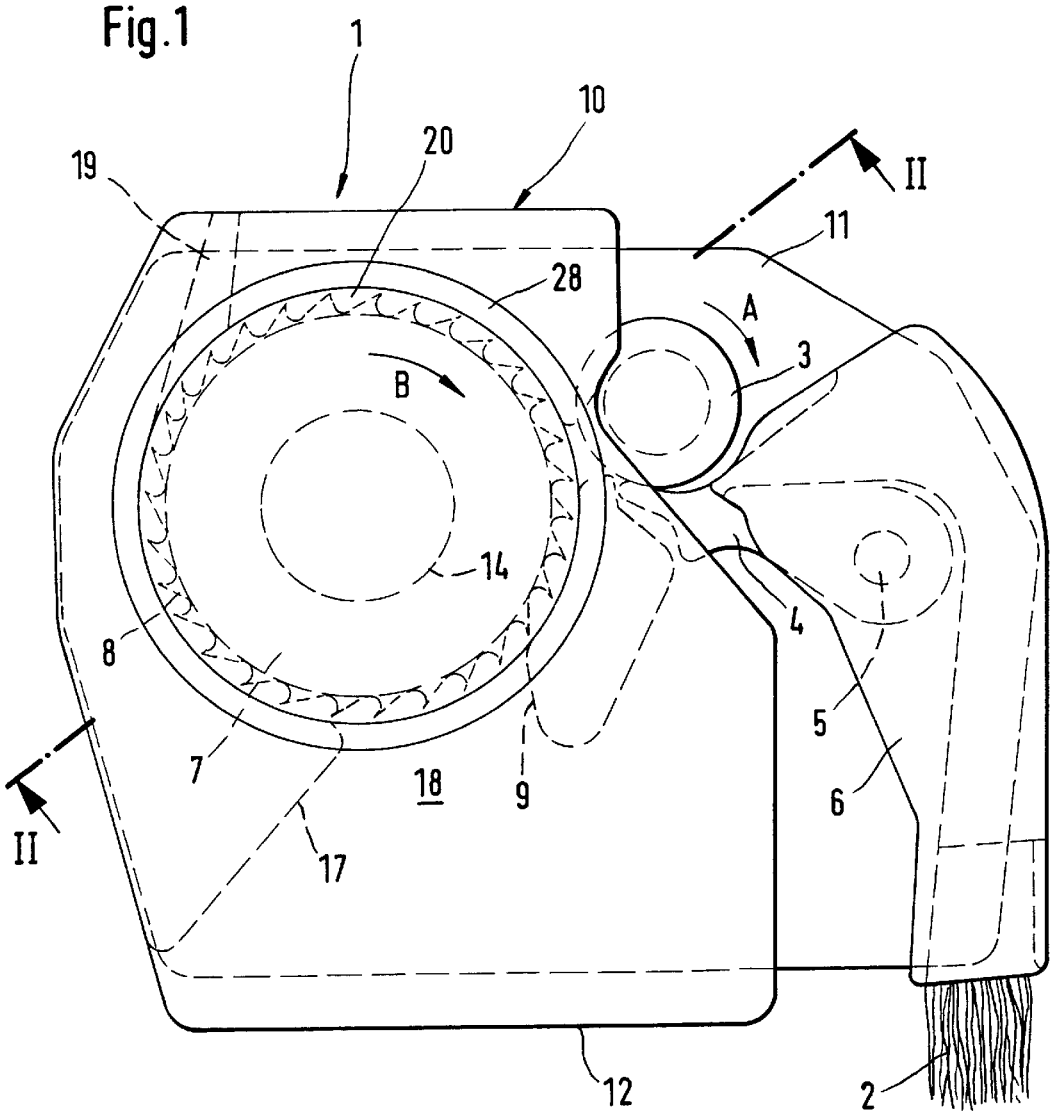
FIG. 1 is a side view of an opening device of the present invention as seen from the operator's side of the open-end spinning machine.
Figure 2:
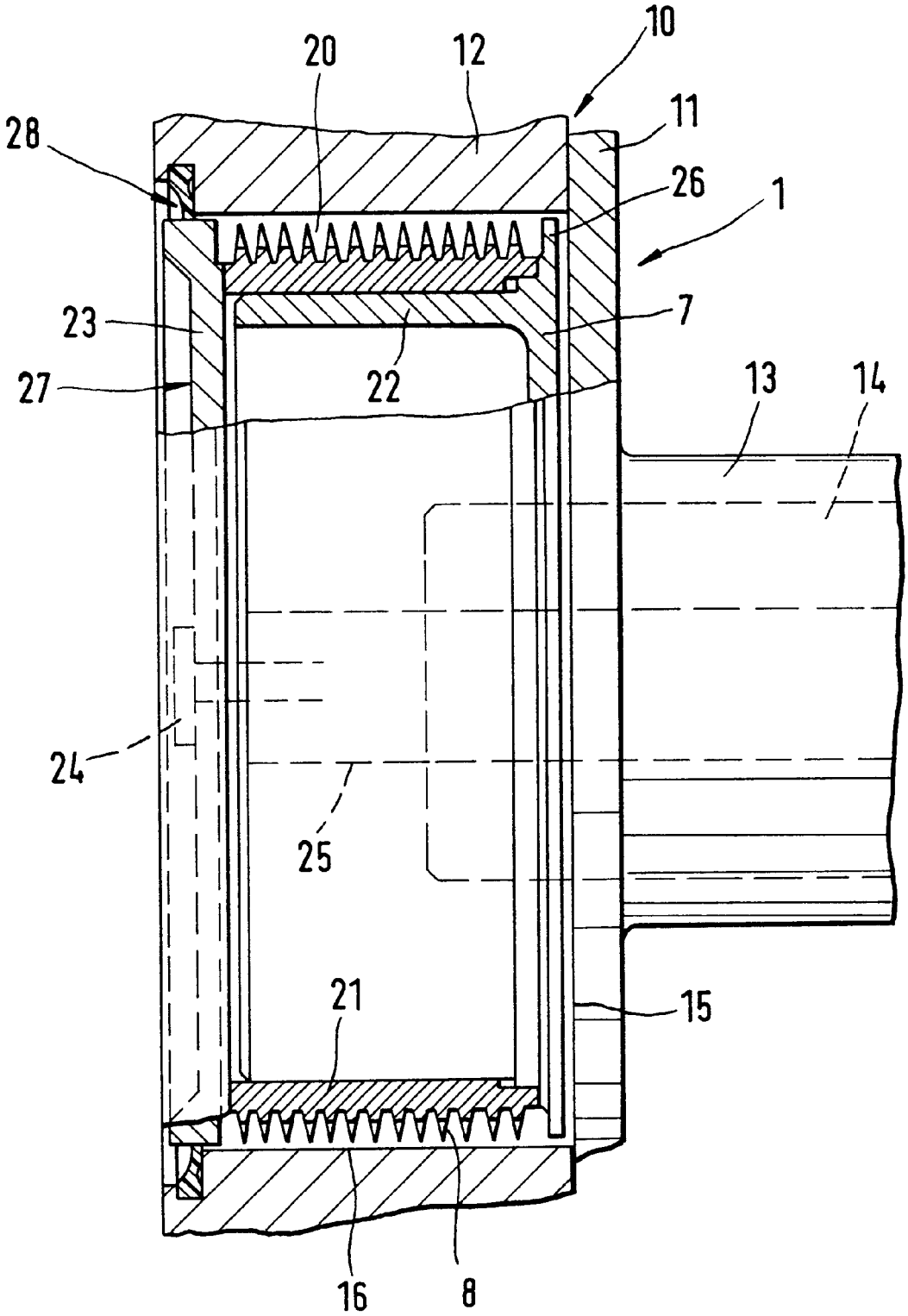
FIG. 2 is a somewhat enlarged longitudinal section of the opening device along the intersection surface II—II of FIG. 1.

The opening device 1 shown in FIGS. 1 and 2 is part of an open-end spinning machine (not shown). The opening device 1 serves to feed a sliver 2 and open it to single fibers. A feed roller 3 driven in rotational direction A is one component provided, to which a feed table 4 is flexibly pressed from below. The feed table 4 can be swivelled around a swivel axle 5 and is loaded against the feed roller 3 by means of a loading spring (not shown). Thus a nipping line is formed between the feed roller 3 and the feed table 4, in which nipping line the sliver 2 is nipped during transport. A feed condenser 6 for the sliver 2 is arranged upstream of the feed roller 3.

The feed roller 3 presents the sliver 2 which is to be opened to single fibers to a significantly faster driven opening roller 7, which is driven in rotational direction B, thus rotating in the same direction as the feed roller 3. The opening roller 7 is provided with a combing structure 8, which can comprise, for example, saw teeth or needles or the like.

A stationary fiber beard support 9 is arranged between the feed table 4 and the opening roller 7, which fiber beard support 9 presses the end of the sliver 2 to be opened, the so-called fiber beard, into the combing structure 8 of the opening roller 7 from the back side.

The above mentioned components are housed in a housing 10, which is essentially comprised of two housing parts 11 and 12.

The housing part 11 serves in a way not shown to affix the entire housing 10 to a holding device of the spinning arrangement and further to affix the bearing of the opening roller 7. The housing part 11 is provided for this purpose with a cylindrical receiver 13 for a bearing housing 14 of the opening roller 7. The part housing 11 comprises further a flat stopping surface 15, on which the other housing part 12 is mounted in a way not shown.

The second housing part 12 serves essentially as the circumferential covering of the opening roller 7, and has for this purpose at least one peripheral surface 16, which surrounds the opening roller 7 over a part of its circumference while forming an annular space. Furthermore, guiding surfaces 17 are applied to the housing part 12, for example, for bordering a trash removal opening 18.

A fiber feed channel 19 begins in the housing 10, which fiber feed channel feeds the opened single fibers from the combing means 8 of the opening roller 7 to a spinning rotor. The spinning rotor and therewith the annular space are connected to a vacuum source, which serves the transport of the single fibers. The annular space is thus a chamber 20 connected to said vacuum source. The opening roller 7 comprises an exchangeable ring 21, which comprises the combing structure 8 and which is slid onto a base body 22 of the opening roller 7. A tension disc 23 serves to affix the ring 21 onto the base body 22, which tension disc is at the same time a lateral collar of the opening roller 7 and is affixed by means of a screw 24 to a shaft 25 of the opening roller 7. The tension disc 23 braces the ring 21 against a flange 26 of the base body 22.

The front side end face 27 of the opening roller 7 facing away from the housing part 11 is not covered by a lid and is thus exposed directly to the open atmosphere. In order to seal it from the chamber 20, the tension disc 23 of the opening roller 7 is sealed off from the housing part 12 by means of sealing ring 28 which will be described below. In order that no false air, which could disturb the spinning process, penetrates into the interior of the housing 10, the chamber 20 must be sealed off against the open atmosphere. In addition, fly accumulation must be prevented from settling in the gaps surrounding the opening roller 7. The embodiments of sealing rings 28 described in the following FIGS. 3 to 12 serve this purpose.

Figure 3:
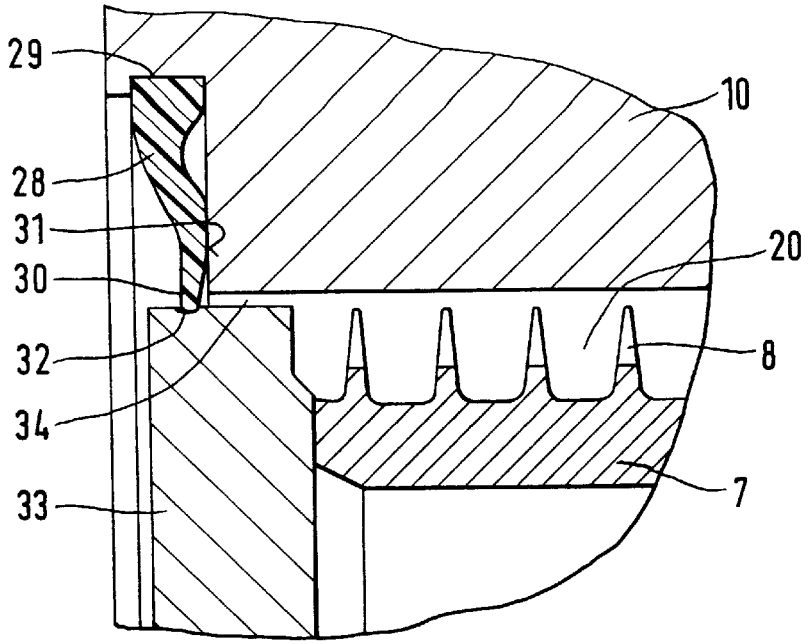
FIGS. 3 to 12 show greatly enlarged part views of FIG. 2 of various embodiments of a sealing ring constructed according to the present invention.

The sealing ring 28 is shown in FIG. 3 in an enlarged part view. It is made of flexible plastic and is supported concentrically to the opening roller 7 in a groove 29 in the housing 10. The sealing ring 28 comprises a sealing lip 30 on its inner diameter, which defines the smallest diameter of the sealing ring 28, which sealing lip 30 is arranged to contact a sealing surface 32 of the opening roller 7. The sealing surface 32 in this case is a slight recess in the outer periphery of a cylindrical lateral collar 33 of the opening roller 7. The collar 33 corresponds hereby to the tension disc 23. The recess of the sealing surface 32 measures only a few tenths of a millimeter. When the opening roller 7 is applied for the first time in the spinning arrangement, the sealing lip 30 is allowed to drag along the sealing surface 32, as it should be ground in.

Under the action of the pressure drop existing between the open atmosphere and the chamber 20, the sealing ring 28 is disposed against a stationary, radial stopping surface 31 which is arranged on the housing 10. The sealing ring 28 hereby attains its operational position, whereby no significant demands have to be made on the tolerances in axial direction of the opening roller 7. Due to the grinding in of the sealing lip 30 on the sealing surface 32, the tolerances in radial direction are also of no significance.

The disposition of the sealing ring 28 on the stopping surface 31 has the additional advantage in that it is more difficult for the fly accumulation to reach the gap between the sealing ring 28 and the stopping surface 31.

As can be seen, the sealing lip 30, which defines the smallest diameter of the sealing ring 28, has a larger diameter than the combing structure 8. Thus the opening roller 7 can be slid laterally into the chamber 20 of the housing 10, without the sealing lip 30 being damaged by the sharp combing structure 8. The diameter ratios also make it possible to arrange the sealing ring 28 directly at the housing 10 and to omit the need for any sort of covering of the housing by means of a lid.

The outer periphery of the collar 33 forms an additional sealing gap 34 with the inner circumference of the housing 10, which supports the overall sealing effect.

The advantages described with the aid of FIG. 3, namely the utilizing of the considerable pressure drop for the operational position of the sealing ring 28, the grinding in of the sealing lip 30 on the sealing surface 32 and the lateral sliding of the opening roller 7 into the housing 10 without damaging the sealing ring 28, are also attained by the embodiments described below according to FIGS. 4 to 12. A repeat description of these advantages can therefore be omitted, and reference is made hereto to the explanation of FIG. 3.

Figure 4:
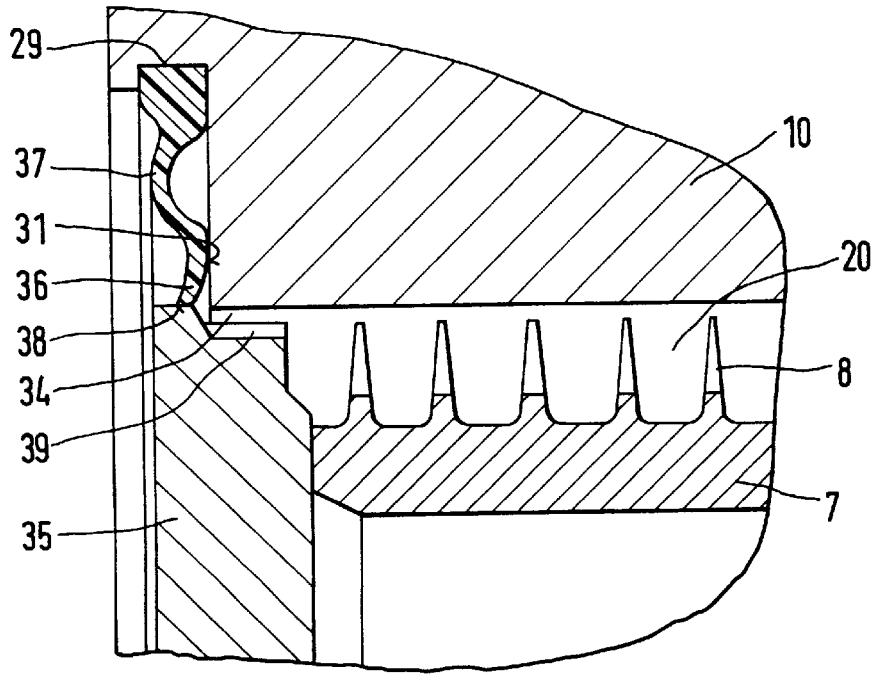

In the embodiment according to FIG. 4, a somewhat differently designed sealing ring 37 is shown, in which the sealing surface 38 arranged at the sealing lip 36 is part of the outer periphery of a stepped collar 35. During the first running-in of the opening roller 7 after operation of the spinning arrangement has begun, the sealing lip 36 of the sealing ring 37 is disposed on a sealing surface 38, which is formed by the larger diameter of the stepped collar 35. The inner diameter of the sealing lip 36 deviates even further from the outer diameter of the combing structure 8 than in the FIG. 3 arrangement, so that when the opening roller 7 is being inserted into the housing 10, any possible damage to the sealing ring 37 is even more effectively avoided. Between the smaller outer diameter of the stepped collar 35 and the cylindrical inner surface of the housing 10 an additional sealing gap 34 is also formed, whereby the smaller diameter can be additionally provided with repelling notches 39, which serve to ensure that fibers which fly laterally out of the chamber 20 are transported back thereto.

It is sufficient to indicate the steps of the collar 35 only slightly. The repelling notches 39 present on the smaller diameter of the collar 35 extend diagonally, so that a knock-back effect arises in the direction of the chamber 20.

The sealing ring 37 in this embodiment is somewhat more curved, so that the pressure drop between the open atmosphere and the chamber 20 can more easily press the sealing ring 37 against the stationary stopping surface 31 located on the housing 10. The operational position of the sealing ring 37 and in particular of the sealing lip 36 is hereby set.

Figure 5:
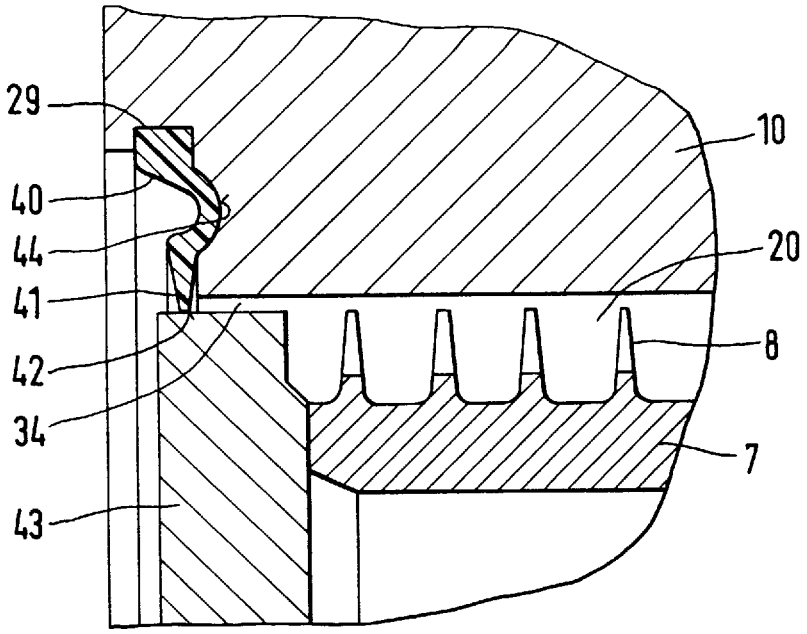

In the embodiment according to FIG. 5, a stopping surface 44 is provided on the housing 10, which stopping surface is constructed corresponding to the curvature of the sealing ring 40. By this means, under the action of the described pressure drop, the sealing ring 40 easily finds its operational position, whereby the sealing lip 41 does not need to be disposed on the wall of the housing 10 any more. The sealing lip 41, tapering to a point in the manner of a comma, also grinds in on the rotating sealing surface 42 in this embodiment, which sealing surface 42 is formed by a cylindrical outer circumference of a collar 43 of the opening roller 7.

Figure 6:
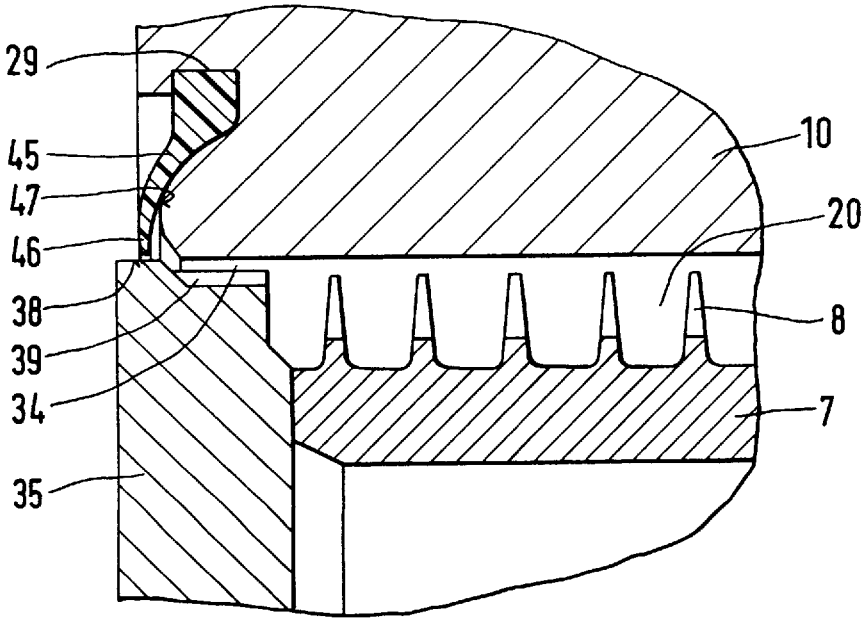

In the embodiment according to FIG. 6, a stepped collar 35 is again provided, whereby the smaller diameter forms an additional sealing gap 34 with the inner contour of the housing 10 and is also provided with repelling notches 39. On the periphery of the larger diameter of the stepped collar 35, a sealing surface 38 is again provided, on which the tapering sealing lip 46 of a sealing ring 45 is disposed during grinding in.

The sealing ring 45 in this embodiment is curved towards the operator's side of the spinning arrangement and is disposed, under the action of the pressure drop, against a correspondingly counter-formed stopping surface 47 of the housing 10. The sealing lip 46 is hereby free from the wall of the housing 10.

Figure 7:
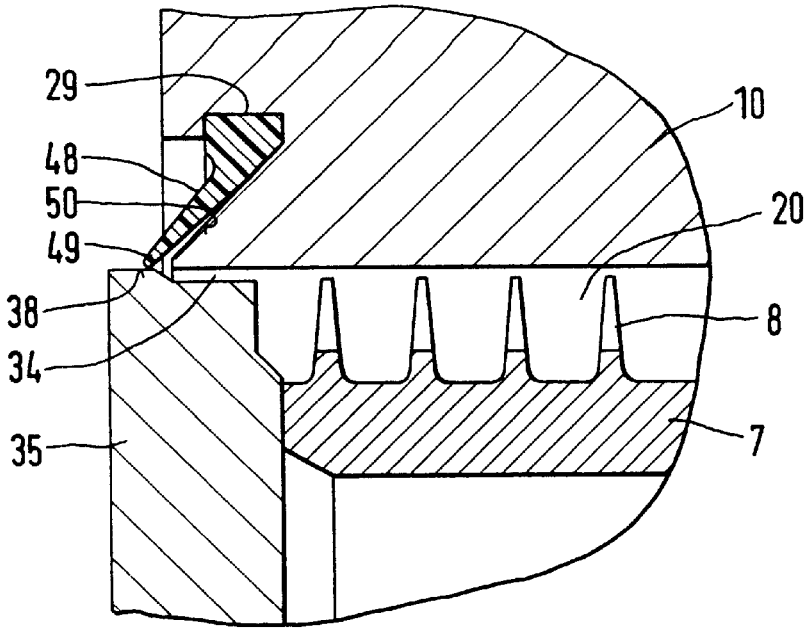

The embodiment of the present invention shown in FIG. 7 corresponds to a large extent to that of FIG. 6, whereby the contour of the sealing ring 48 facing the housing 10 is not curved, but rather conically formed. The sealing ring 48 is thereby disposed on a correspondingly formed conical stopping surface 50 of the housing 10. The sealing lip 49 is again arranged at the larger outer diameter of a stepped collar 35, which comes into contact with the sealing lip 49 during grinding in and so forms the sealing surface 38.

Figure 8:
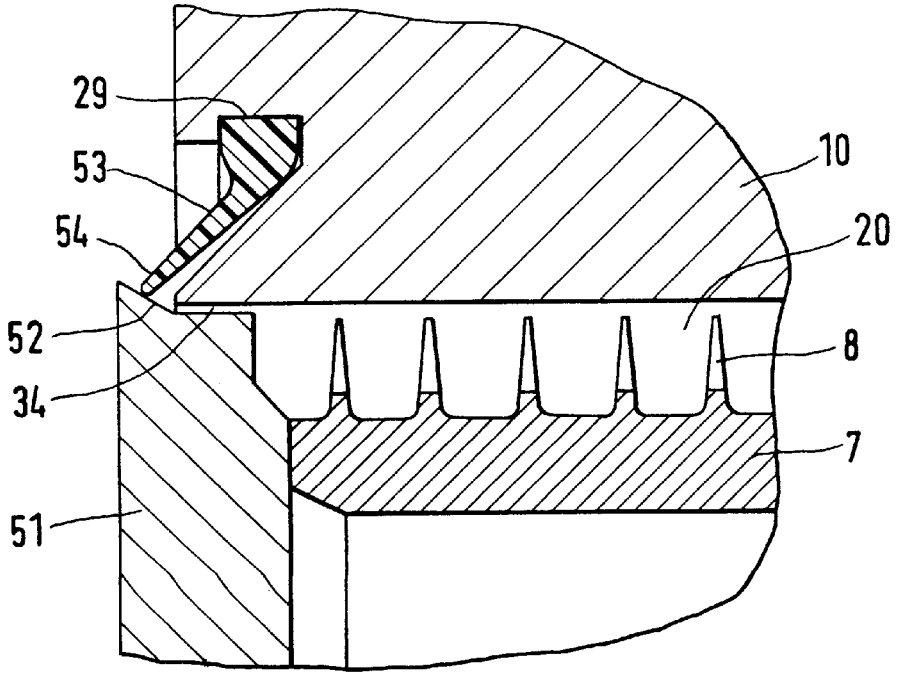

The variation of the present invention shown in FIG. 8 deviates from the embodiments of the present invention described above in that a stopping surface 52 is provided, which is located at a slightly conical area of a lateral collar 51 of the opening roller 7. The conicality of the collar 51 increases slightly in the direction of the operator's side, starting from a cylindrical outer diameter defined by a sealing gap 34.

The sealing ring 53, supported again in a ring groove 29 of the housing 10, is not disposed here on a surface of the housing 10, but rather—at least during grinding in—only on the stopping surface 52 of the opening roller 7. The stopping surface 52 hereby defines the respective operational position of the sealing ring 53, which position can change with increased grinding in as with decreasing diameter of the sealing lip 54 the sealing ring 53 is pressed more and more onto the wall of the housing 10.

Despite this fact, in this embodiment of the present invention, any tolerances in radial direction are easily overcome. In the final stage, the sealing ring 53 may come to rest on a corresponding surface of the housing 10, namely when the sealing lip 54 at some time no longer touches the stopping surface 52 of the collar 51. The sealing effect is, however, maintained.

Figure 9:
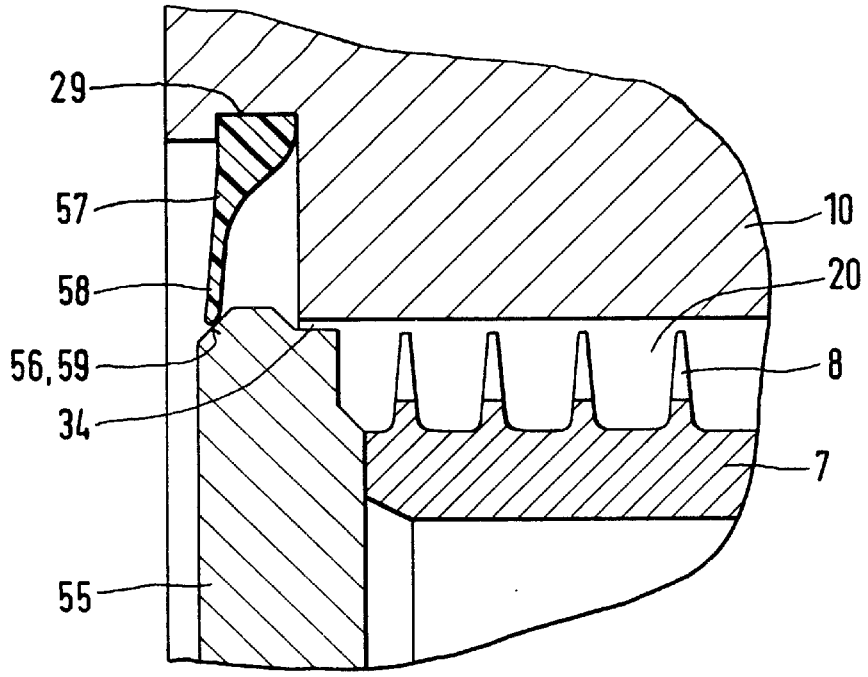

In the embodiment of the present invention according to FIG. 9, the stopping surface 59, which is at the same time the sealing surface 56, is again formed by a lateral collar 55 of the opening roller 7. The collar 55 is again stepped, its smaller outer diameter forming with the inner wall of the housing 10 the additional sealing gap 34 described above.

The collar 55 has a slanted surface, which tapers conically towards the operator's side and forms the stopping surface 59 for the sealing lip 58 of the sealing ring 57. Due to the action of the pressure drop between the open atmosphere and the chamber 20, the sealing lip 58 is disposed against the conical stopping surface 59 and is thus ground in in an ideal way. As, due to increasing grinding in and thus the displacing of the sealing lip 58 under the action of the pressure drop, the spring rigidity of the sealing ring 57 continuously increases, a balance between the pressure drop and the rigidity of the sealing ring 57 comes about at some point in time, so that the sealing lip 58 hardly touches the stopping surface 59.

Figure 10:
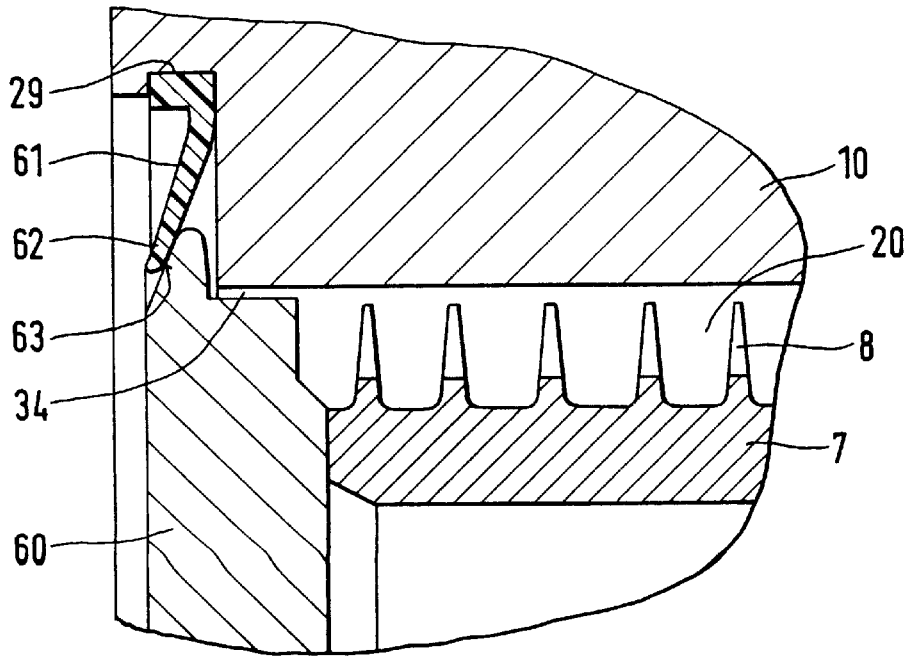

In the embodiment of the present invention as shown in FIG. 10, a conical stopping surface 63 is provided on the lateral collar 60 of the opening roller 7. The stopping surface 63 is at the same time the sealing surface for the sealing lip 62 of the sealing ring 61, which is again supported in a groove 29 of the housing 10. In this embodiment, the sealing lip 62 has to be raised somewhat when the opening roller 7 is inserted laterally into the chamber 20 of the housing 10 during assembly.

In the present case the sealing lip 62 is disposed during the entire operational time of the opening roller 7 on the stopping surface 63. If, however, a low friction plastic is used for the sealing ring 61, this does not lead to any noticeable increase in power consumption of the spinning arrangement.

Figure 11:
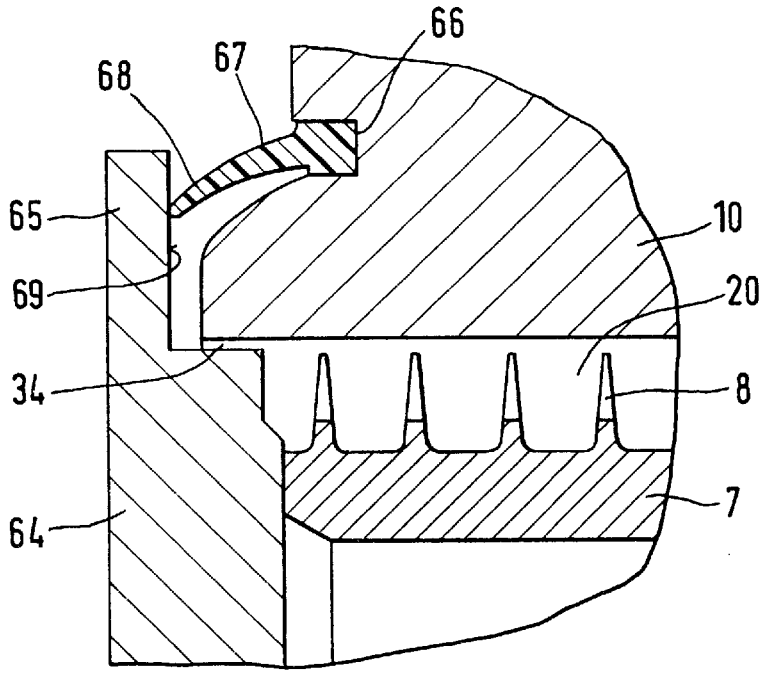

The embodiment of the present invention as shown in FIG. 11 differs from the embodiments described up to now in that the sealing ring 67 is effective not in radial, but in axial direction. This is not as favorable, with regard to the tolerances, as the embodiments of the present invention described above, but is still however in the present case practicable, as here again the pressure drop present between the open atmosphere and the chamber 20 can be used to advantage to overcome any tolerances.

The collar 64 comprises here, outside of the sealing gap 34, a greatly enlarged diameter area, which comprises on the side facing the housing 10 a plane radial surface, against which the sealing lip 68 of a sealing ring 67 supported in a groove 66 of a housing 10 is disposed in axial direction. The area 65 thus defines the operational position of the sealing ring 67. If required, the wall of the housing 10 arranged to engage the sealing ring 67 can be adapted with regard to its contour to the sealing ring 67 in such a way that, after a sufficient grinding in of the sealing lip 68, the sealing ring 67 can be disposed on this wall.

Figure 12:
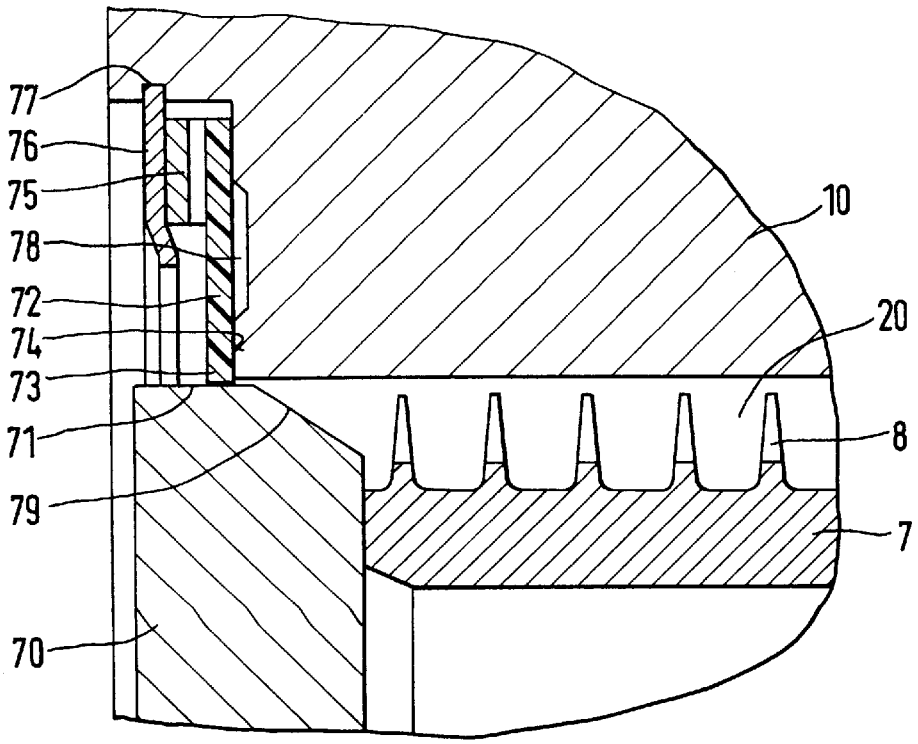

In the embodiment of the present invention as shown in FIG. 12, a so-called floating sealing ring 72 is provided. This comprises a sealing lip 73, which again can be disposed on the cylindrical surface 71 formed by the outer circumference of a lateral collar 70.

The floating sealing ring 72 is pressed against the stopping surface 74 of the housing 10 by means of a corrugated spring 75. The stopping surface 74 comprises a recess 78, which can take up trash particles, which despite everything, still manage to get between the sealing ring 72 and the stopping surface 74.

The corrugated spring 75 is supported on the outside against a securing ring 76, which is guided into a ring groove 77 of the housing 10.

The sealing ring 72 is made of low friction plastic and is plane in construction, as in this way it can be most exactly produced. During the first run-in of the opening roller 7, the floating sealing ring 72 finds its ideal position and is later hardly touched by the collar 70. Location of the position is made possible in that the sealing ring 72 has clearances at its outer diameter in radial direction.

The collar 70 comprises on its side facing the chamber 20 an insertion bevel 79, by means of which the sealing ring 72 can be pre-centered during the first assembly of the opening roller 7.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An opening device for an open-end spinning machine comprising an opening roller with combing structure, which rotates in a chamber of a housing connected to a vacuum source, said opening roller comprising a sealing surface at which is arranged a sealing lip of a flexible sealing ring concentrically supported with respect to the opening roller in the housing, which sealing ring seals the chamber against the open atmosphere, wherein the sealing ring is disposed under the action of a pressure drop present between open atmosphere and the chamber on a stopping surface which defines its operational position, and wherein the sealing lip, which defines the smallest diameter of the sealing ring, has a larger diameter than the combing structure.

2. An opening device according to claim 1, wherein the stopping surface is arranged on the opening roller.

3. An opening device according to claim 2, wherein the stopping surface is formed by a slanted surface of a lateral collar of the opening roller.

4. An opening device according to claim 3, wherein the sealing lip in use drags along the sealing surface during a running-in time of the sealing ring.

5. An opening device according to claim 3, wherein in an area of the sealing ring, a lateral collar of the opening roller forms with its cylindrical outer surface an additional sealing gap with the housing.

6. An opening device according to claim 5, wherein a stepped collar is provided with a larger and a smaller diameter, whereby the additional sealing gap is arranged at the smaller diameter and the combing structure is directly adjacent the smaller diameter.

7. An opening device according to claim 2, wherein an outer circumference of a lateral collar of the opening roller is arranged as a sealing surface with respect to the sealing lip.

8. An opening device according to claim 7, wherein the sealing lip in use drags along the sealing surface during a running-in time of the sealing ring.

9. An opening device according to claim 7, wherein a floating sealing ring is provided.

10. An opening device according to claim 2, wherein the sealing lip in use drags along the sealing surface during a running-in time of the sealing ring.

11. An opening device according to claim 2, wherein in an area of the sealing ring, a lateral collar of the opening roller forms with its cylindrical outer surface an additional sealing gap with the housing.

12. An opening device according to claim 11, wherein a stepped collar is provided with a larger and a smaller diameter, whereby the additional sealing gap is arranged at the smaller diameter and the combing structure is directly adjacent the smaller diameter.

13. An opening device according to claim 1, wherein the stopping surface is arranged on the housing.

14. An opening device according to claim 13, wherein an outer circumference of a lateral collar of the opening roller is arranged as a sealing surface with respect to the sealing lip.

15. An opening device according to claim 13, wherein the sealing lip in use drags along the sealing surface during a running-in time of the sealing ring.

16. An opening device according to claim 13, wherein in an area of the sealing ring, a lateral collar of the opening roller forms with its cylindrical outer surface an additional sealing gap with the housing.

17. An opening device according to claim 16, wherein a stepped collar is provided with a larger and a smaller diameter, whereby the additional sealing gap is arranged at the smaller diameter and the combing structure is directly adjacent the smaller diameter.

18. An opening device according to claim 1, wherein the sealing lip in use drags along the sealing surface during a running-in time of the sealing ring.

19. An opening device according to claim 18, wherein a floating sealing ring is provided.

20. An opening device according to claim 18, wherein in an area of the sealing ring, a lateral collar of the opening roller forms with its cylindrical outer surface an additional sealing gap with the housing.

21. An opening device according to claim 20, wherein a stepped collar is provided with a larger and a smaller diameter, whereby the additional sealing gap is arranged at the smaller diameter and the combing structure is directly adjacent the smaller diameter.

22. An opening device according claim 1, wherein in an area of the sealing ring, a lateral collar of the opening roller forms with its cylindrical outer surface an additional sealing gap with the housing.

23. An opening device according to claim 22, wherein a stepped collar is provided with a larger and a smaller diameter, whereby the additional sealing gap is arranged at the smaller diameter and the combing structure is directly adjacent the smaller diameter.

24. A method of making an opening device for an open-end spinning machine comprising:

providing a housing with a chamber connectible in use to a vacuum source, disposing an opening roller in said housing, said opening roller having a sealing surface, and concentrically supporting a sealing ring at the housing so as to seal the chamber with respect to adjacent open atmosphere, wherein the sealing ring is disposed under the action of a pressure drop present between open atmosphere and the chamber on a stopping surface which defines its operational position, and wherein the sealing lip which defines the smallest diameter of the sealing ring, has a larger diameter than the combing structure.

25. A method according to claim 24, wherein the stopping surface is arranged on the opening roller.

26. A method according to claim 25, wherein the stopping surface is formed by a slanted surface of a lateral collar of the opening roller.

27. A method according to claim 24, wherein the stopping surface is arranged on the housing.

28. A method according to claim 24, wherein the sealing lip in use drags along the sealing surface during a running-in time of the sealing ring.

29. A method according to claim 24, wherein a floating sealing ring is provided.

30. A method according to claim 24, wherein in an area of the sealing ring, a lateral collar of the opening roller forms with its cylindrical outer surface an additional sealing gap with the housing.

31. A method according to claim 30, wherein in an area of the sealing ring, a lateral collar of the opening roller forms with its cylindrical outer surface an additional sealing gap with the housing.

* * * * *